US010329973B2

(12) United States Patent
Handa et al.

(10) Patent No.: US 10,329,973 B2
(45) Date of Patent: Jun. 25, 2019

(54) ENGINE OIL DETERIORATION DIAGNOSIS DEVICE

(71) Applicant: MAZDA MOTOR CORPORATION, Hiroshima (JP)

(72) Inventors: Tomohisa Handa, Hatsukaichi (JP); Kunihiro Nishi, Higashihiroshima (JP); Hisashi Okazawa, Hiroshima (JP); Kenko Ujihara, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 322 days.

(21) Appl. No.: 15/458,426

(22) Filed: Mar. 14, 2017

(65) Prior Publication Data

US 2017/0276039 A1 Sep. 28, 2017

(30) Foreign Application Priority Data

Mar. 25, 2016 (JP) ..... 2016-061849

(51) Int. Cl.
*F01M 11/10* (2006.01)

(52) U.S. Cl.
CPC ..... *F01M 11/10* (2013.01); *F01M 2011/1426* (2013.01); *F01M 2011/1486* (2013.01)

(58) Field of Classification Search
CPC ..... F01M 11/10; F01M 2011/1426; F01M 2011/1486
See application file for complete search history.

(56) References Cited

FOREIGN PATENT DOCUMENTS

JP H10-038605 A 2/1998
WO WO-2017013845 A1 * 1/2017 ..... F01M 11/10

* cited by examiner

*Primary Examiner* — Aaron L Troost
(74) *Attorney, Agent, or Firm* — Studebaker & Brackett PC

(57) ABSTRACT

Provided is an engine oil deterioration diagnosis device (10) comprising annual traveling distance calculating part (16), a used hour calculating part (18), a severe condition determining part (20), an oil traveling distance calculating part (22), an oil traveling distance accumulating part (24), and an engine oil deterioration diagnosis part (26) for diagnosing that engine oil is in a state of deterioration when an oil traveling distance accumulated by the oil traveling distance accumulating part reached a predetermined value, wherein the oil traveling distance calculating part (22) comprises an oil traveling distance addition correcting part (32) for calculating the oil traveling distance by adding a predetermined value to the traveling distance when the severe condition determining part determines the state as the severe condition.

4 Claims, 3 Drawing Sheets

ENGINE OIL DETERIORATION DIAGNOSIS DEVICE

TECHNICAL FIELD

The present invention relates to an engine oil deterioration diagnosis device, and more particularly to an engine oil deterioration diagnosis device for diagnosing engine oil deterioration in a vehicle engine.

BACKGROUND ART

Conventionally, as described in Patent Document 1 (JP H10-038605A), a vehicle maintenance period informing device has been known and includes an arrangement which accumulates traveling distance of a vehicle and provides information at every predetermined accumulated traveling distance that oil replacement is recommended.

In such method of providing information at every predetermined accumulated traveling distance that oil replacement is recommended, usually, a predetermined accumulated traveling distance is determined based on a normal operating state, and information is provided that oil replacement is recommended every time when the predetermined accumulated traveling distance is reached.

SUMMARY

Technical Problem

For example, a vehicle used for a taxi and/or delivery business or the like is operated in an operating state of a severe condition where the traveling distance is long and operating frequency is very high, so that deterioration of engine oil develops very fast. If such development of deterioration is to be reflected to a replacement timing of engine oil, the predetermined accumulated traveling distance may have to be set shorter than in the normal operating state.

However, with such setting, there is a problem that engine oil replacement may be unnecessarily forced to a user who is not operating the vehicle in the state of severe condition despite deterioration of engine oil is not developed.

Thus, the present invention has been made to solve the aforementioned conventional problems, and an object thereof is to provide an engine oil deterioration diagnosis device which can appropriately diagnose engine oil deterioration in two aspects, namely, the traveling distance and the operating frequency represented by used hours per predetermined period.

Solution to Technical Problem

In order to achieve the above object, according to the present invention, there is provided an engine oil deterioration diagnosis device for diagnosing engine oil deterioration in an engine of a vehicle, comprising: an annual traveling distance calculating part for calculating an annual traveling distance based on a traveling distance detected by a traveling distance detecting device; a used hour calculating part for calculating used hours per predetermined period of the vehicle based on used hours of the vehicle; a severe condition determining part for determining a severe condition when a relationship between the annual traveling distance and the used hours per predetermined period meets a determining criteria of the severe condition; an oil traveling distance calculating part for calculating an oil traveling distance based on the traveling distance; an oil traveling distance accumulating part for accumulating the oil traveling distance calculated by the oil traveling distance calculating part to calculate an accumulated oil traveling distance; and an engine oil deterioration diagnosis part for diagnosing that the engine oil is in a state of deterioration when the accumulated oil traveling distance calculated by the oil traveling distance accumulating part reached a predetermined value; wherein the oil traveling distance calculating part comprises: an oil traveling distance normal adding part for calculating the oil traveling distance by adopting the traveling distance, when the severe condition determining part does not determine the state as being in the severe condition; and an oil traveling distance addition correcting part for calculating the oil traveling distance by adding a predetermined value to the traveling distance, when the severe condition determining part determines the state as being in the severe condition.

According to the present invention having the above features, when the severe condition determining part determines that the relationship between the annual traveling distance and the used hours per predetermined period X falls in the category of severe condition, the oil traveling distance addition correcting part functions to calculate the oil traveling distance by adding a predetermined value to the traveling distance, and when the accumulated oil traveling distance reaches the predetermined value, the engine oil deterioration diagnosis part functions to diagnose that the engine oil is in the state of deterioration. With this operation, in the present invention, it is possible to appropriately diagnose engine oil deterioration in terms of two aspects, namely, the traveling distance and the operating frequency represented by used hours per predetermined period.

According to the present invention, it is preferable that the oil traveling distance calculating part further comprises an oil traveling distance initial correcting part, wherein the oil traveling distance initial correcting part is configured to adopt the oil traveling distance calculated by the oil traveling distance normal adding part until the traveling distance of the vehicle reaches a predetermined value counted from the timing of vehicle production or the timing of engine oil replacement, and to determine as to whether the oil traveling distance calculated by the oil traveling distance addition correcting part shall be adopted for the predetermined traveling distance after the traveling distance of the vehicle has reached the predetermined traveling distance.

According to the present invention having the above features, the oil traveling distance initial correcting part functions to adopt the oil traveling distance from the oil traveling distance normal adding part by holding the result of determination by the severe condition determination part during the period from the timing of vehicle production or the engine oil replacement to the timing when the vehicle traveling distance reaches the predetermined traveling distance, and once the vehicle traveling distance reaches the predetermined distance, it determines as to whether the oil traveling distance from the oil traveling distance addition correcting part shall be adopted for the predetermined traveling distance. Thus, it is possible to prevent the state from being determined as the sever condition when the vehicle travels a relatively long distance temporarily during the period from the timing of vehicle production or the engine oil replacement to the timing when the vehicle traveling distance reaches the predetermined traveling distance. With this operation, in the present invention, it becomes possible to further improve accuracy of the determination of the severe condition, and more accurate diagnose can be effected on the engine oil deterioration from two aspects, namely, the traveling distance and the operating frequency represented by used hours per predetermined period, to thereby make it possible to appropriately determine the timing of engine oil replacement.

According to the present invention, it is preferable that the oil traveling distance calculating part further comprises an oil traveling distance reduction correcting part, wherein the oil traveling distance reduction correcting part is configured to calculate a reduced oil traveling distance having a value reduced from the traveling distance during a period when, after determination of a state by the severe condition determining part has changed from the severe condition to a non-severe condition, the state determined as the non-severe condition continues.

According to the present invention having the above features, after the determination of the operating state by the severe condition determination part is changed from the state determined as the severe condition to the state not determined as the severe condition, during the period where the state not determined as the severe condition is being continued, the oil traveling distance reduction limiting part functions to calculate the oil traveling distance having a value reduced from the traveling distance. This operation is done considering that under a situation wherein the traveling distance became temporarily long for a limited period, but after that, there may be a possibility that the operating state may have returned to an usual mode. Thus, under a situation where the state is determined as the severe condition, calculation of the oil traveling distance has been made by adding thereto a predetermined value by the oil traveling distance addition correcting part, but under a situation where the determination of the state has been changed as described, the reduced oil traveling distance is used after such change, so that it is possible to reduce the increase in the accumulated oil traveling distance to thereby effect correction to have the value of the accumulated oil traveling distance approached to the actual traveling distance.

Thus, even if there occurs temporarily a state determined as the operating state of the severe condition, when the operating state is returned to the usual mode, it is possible to correct the accumulated value of the oil traveling distance to thereby have it approached to the accumulated value of the traveling distance. It is thereby possible in the present invention to more accurately diagnose engine oil deterioration in terms of two aspects, namely, the traveling distance and the operating frequency represented by used hours X per predetermined period to thereby appropriately determine the timing of engine oil replacement.

According to the present invention, it is further preferred that the oil traveling distance calculating part further comprises an oil traveling distance reduction limiting part, wherein the oil traveling distance reduction limiting part is configured to limit the adoption of the oil traveling distance calculated by the oil traveling distance reduction correcting part if the accumulated oil traveling distance obtained by accumulating the reduced oil traveling distance calculated by the oil traveling distance reduction correcting part becomes equal to a value of the traveling distance in the period from the timing of vehicle production or the timing of engine oil replacement to the timing of determination.

According to the present invention having the above features, in a case where the correction for having the accumulated oil traveling distance approached to the actual traveling distance is performed using the reduced oil traveling distance calculated by the oil traveling distance reduction correcting part, when the accumulated oil traveling distance calculated by the oil traveling distance accumulating part for the period from the timing of vehicle production or the timing of engine oil replacement to the timing of determination reached a value equal to the traveling distance from the timing of vehicle production or the timing of engine oil replacement to the timing of determination, the oil traveling distance reduction limiting part functions to limit the adoption of the oil traveling distance from the oil traveling distance reduction correcting part so that the accumulated oil traveling distance may not become lower than the traveling distance from the timing of vehicle production or the timing of engine oil replacement to the timing of determination.

Thus, according to the present invention, under a situation where the state has been determined temporarily as the operating state of the severe condition but has been returned to an operating state of the usual mode, it is possible to limit the adoption or activation so that the accumulated oil traveling distance may not become equal to or less than the actual traveling distance, to thereby have the operation returned to the calculation of the oil traveling distance under the operating state of the usual mode. Therefore, in the present invention, it is possible to diagnose engine oil deterioration more accurately in terms of two aspects, namely the traveling distance and the operating frequency represented by used hours per predetermined period, to thereby appropriately determine the timing of engine oil replacement.

Meritorious Effect of Invention

According to the engine deterioration diagnosis device of the present invention, it is possible to appropriately diagnose engine oil deterioration from two aspects, namely, from the aspect of the traveling distance and the aspect of the operating frequency represented by used hours per predetermined period.

DETAILED DESCRIPTION

Figure 1:
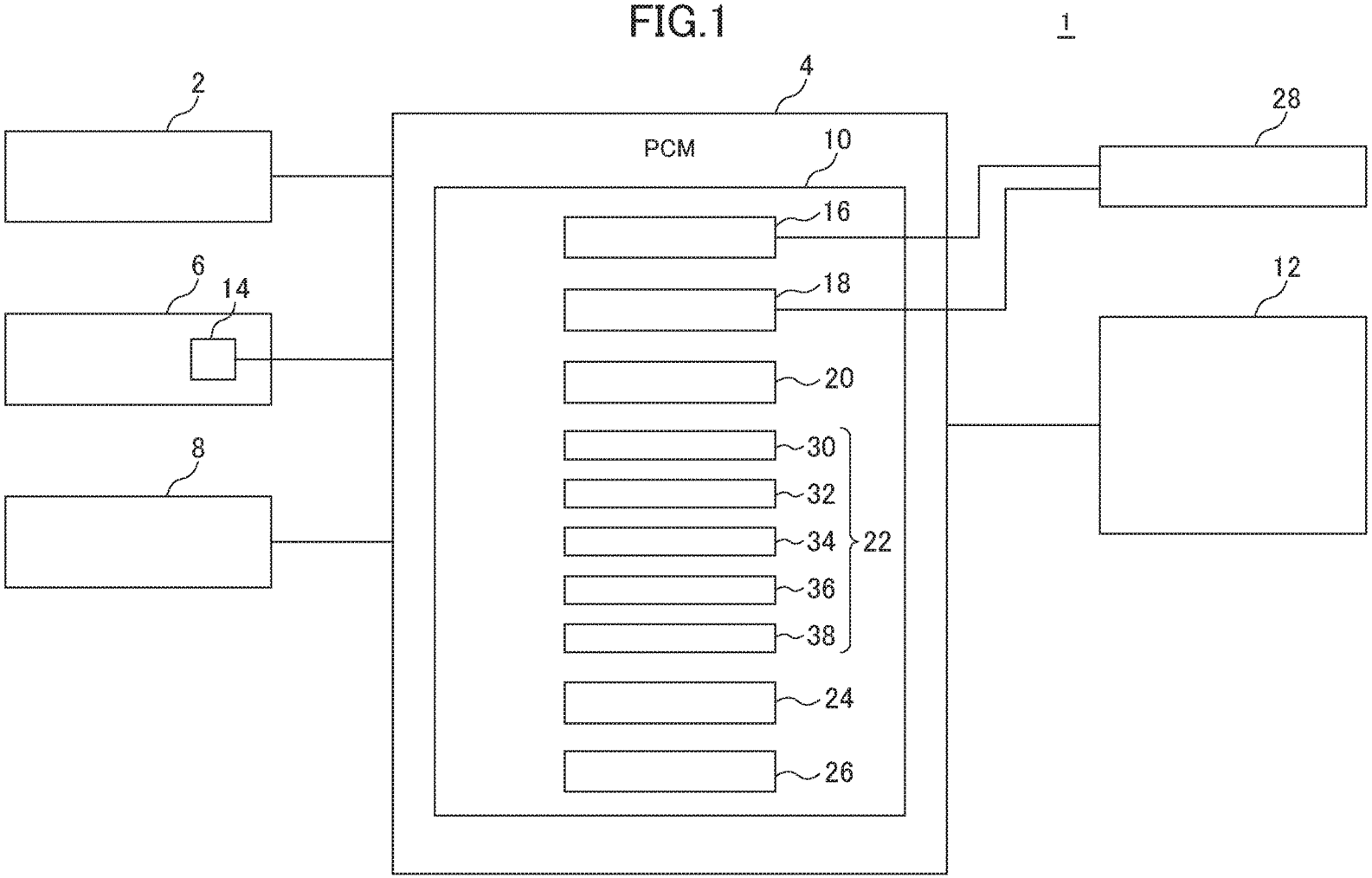
FIG. 1 is a schematic diagram of an engine system to which an engine oil deterioration diagnosis device according to one embodiment of the present invention is applied.

With reference to the accompanying drawings, description will be made on an engine system to which an engine oil deterioration diagnosis device according to one embodiment of the present invention is applied. FIG. 1 is a schematic diagram of an engine system to which an engine oil deterioration diagnosis device according to one embodiment of the present invention is applied.

An engine system 1 to which an engine oil deterioration diagnosis device 10 according to one embodiment of the present invention is applied comprises an engine (internal combustion engine) 2 provided on a vehicle (not shown); a powertrain control module 4 (hereinafter referred as PCM) for controlling the engine system 1; a battery 6 for supplying electric power to the PCM 4 and other functional units; a traveling distance detecting device 8 for detecting a traveling distance of the vehicle; an engine oil deterioration diagnosis device 10 for diagnosing engine oil deterioration of the engine 2; and an informing device 12 for informing replacement opportunity of engine oil when it is diagnosed that the engine oil is in a state of deterioration.

The engine 2 is configured such that engine oil circulates therein. In the engine, the engine oil plays various roles such as of lubrication of a piston mechanism and/or a valve opening and closing mechanism, and cooling of the engine 2 or the like. During use of the engine 2, the engine oil suffers heat of the engine 2 or takes sludge generated within the engine 2 in itself, so that its performance gradually get deteriorated. Thus, when a predetermined condition is met, the engine oil replacement is required.

The PCM 4 comprises an input interface (not shown) for receiving data sent from respective units of the vehicle; a CPU (not shown) for executing computation to perform controls of the respective units of the vehicle; a memory (not shown) for storing programs, data and control signals to perform controls of the respective units of the vehicle; and an output interface (not shown) for sending control signals to the respective units of the vehicle.

The program for realizing the engine oil deterioration diagnosis device 10 of the present invention, and data and tables used for executing such program are stored on the memory. In addition, the memory is provided with a workspace for the computation by the CPU, and the data sent from the respective units of the vehicle and the control signals to be sent to the respective units of the vehicle are stored in the memory. The PCM 4, functionally, configures the engine oil deterioration diagnosis device 10.

The battery 6 is controlled by the battery controlling part 14 for supplying electric power to the PCM 4 and other functional units. Number of elapsed days D from a timing of vehicle production or a timing of the latest engine oil replacement to a timing of determination (specifically, a point of diagnosis) to be described below is measured by the battery controlling part 14. The battery controlling part 14 is electrically connected to the PCM 4, and the number of elapsed days D detected by the battery controlling part 14 is input to the PCM 4 in the form of an electrical signal.

The traveling distance detecting device 8 is a traveling distance sensor or the like for detecting a rotation of wheels of the vehicle. For example, the traveling distance detecting device 8 is a device for detecting accumulated traveling distance Lt to be used in an odometer (an instrument for indicating an accumulated traveling distance) of the vehicle. The accumulated traveling distance Lt is a traveling distance accumulated during a period from the production of the vehicle to the timing of determination. The accumulated traveling distance Lt is a distance which is obtained by accumulating the detected traveling distance and can be the one which has been generally known, having no specific relationship with various functions or the like of the present invention. The traveling distance detecting device 8 may be another device such as a vehicle speed sensor or the like having a function which enables detection and/or calculation of the traveling distance of the vehicle. The traveling distance detecting device 8 is electrically connected to the PCM 4, and the traveling distance detected by the traveling distance detecting device 8 is input to the PCM 4 in the form of an electrical signal.

The informing device 12 is prepared to receive a command from the PCM 4 and inform to the user that the engine oil is in the state of deterioration. The informing device 12 comprises, for example, a lamp provided on an instrument panel of the vehicle, and by turning on the lamp, information is provided that the replacement opportunity of engine oil has come. Further, the informing device 12 may be a device which uses any other media such as images of figures, video, graphics, texts, symbols, sounds or voice or the like. For example, the informing device 12 may be the one which is designed to provide the user with information that the replacement opportunity of engine oil has come by the images of figures on a monitor provided on the vehicle, which can display information. The informing device 12 is electrically connected to the PCM 4, and the signal output from the PCM 4 is input to the informing device 12 in the form of an electrical signal.

The engine oil deterioration diagnosis device 10 is provided on the PCM 4. The engine oil deterioration diagnosis device 10 may comprise elements outside of the PCM 4 such as the traveling distance detecting device 8 and/or the informing device 12. Further, the engine oil deterioration diagnosis device 10 is not limited to the one which is provided on the PCM 4, and some functions of the engine oil deterioration diagnosis device 10 may be provided on another functioning units other than the PCM 4, and the engine oil deterioration diagnosis device 10 may be configured as a system.

The engine oil deterioration diagnosis device 10 comprises an annual traveling distance calculating part 16, a used hour calculating part 18, a severe condition determining part 20, an oil traveling distance calculating part 22, an oil traveling distance accumulating part 24 and an engine oil deterioration diagnosis part 26.

The annual traveling distance calculating part 16 functions to calculate an annual traveling distance Z based on the traveling distance detected by the traveling distance detecting device 8. Specifically, the annual traveling distance calculating part 16 functions to predict the annual traveling distance Z for a period of one year based on the traveling distance during a period from the timing of production (or the timing of delivery) when measurement for the accumulated traveling distance Lt of the vehicle is started to the timing of determination, when the vehicle is delivered as a newly manufactured vehicle after production to the user. Specifically, an annual traveling distance Z is estimated as a traveling distance for one year by mathematically converting the traveling distance during the period from the timing of vehicle production (or the timing of delivery) to the timing of determination. For example, the traveling distance of 2000 km during half a year from the timing of vehicle production to the timing of determination is mathematically converted (doubled) to the traveling distance for one year to thereby calculate the annual traveling distance of 4000 km. In addition, for example, it is possible that the traveling distance of 8000 km during two years from the timing of production to the timing of determination is mathematically converted (halved) to the traveling distance for one year to thereby calculate the annual traveling distance of 4000 km. In addition, for example, it is possible that the traveling distance of 2000 km from the timing of production to the timing of determination is mathematically converted to the traveling distance for one year by dividing the traveling distance by 100 days which is the number of elapsed days and multiplying 365 days, to thereby calculate the annual traveling distance of 7300 km.

When the vehicle is used continuously after the engine oil replacement, the annual traveling distance calculating part 16 functions to predict the annual traveling distance Z for a period of one year after the latest engine oil replacement of the vehicle based on the traveling distance during the period from the timing of the latest engine oil replacement of the vehicle to the timing of determination. Specifically, the annual traveling distance Z is estimated as a traveling distance for one year by mathematically converting the traveling distance during the period from the timing of the latest engine oil replacement to the timing of determination. With respect to the calculating method of the annual traveling distance Z, it is the same as the case of predicting the annual traveling distance Z for the period of one year based on the traveling distance during the period from the timing of production to the timing of determination, so that further description will be omitted.

The annual traveling distance calculating part 16 is configured to receive information of the traveling distance sent from the traveling distance detecting device 8 to the PCM 4. The annual traveling distance calculating part 16 is configured to constantly calculate the annual traveling distance Z based on the traveling distance of the vehicle.

The used hour calculating part 18 functions to calculate used hours X of the vehicle per predetermined period based on the used hours of the vehicle. The used hours X per predetermined period is average used hours during every predetermined short period of time, and it may be the used hours per day [time/day], for example. The used hour calculating part 18 functions to calculate a sum of used hours T of the engine 2 of the vehicle from the timing of vehicle production or the like or the timing of the latest engine oil replacement of the vehicle to the timing of determination. The used hour calculating part 18 functions to acquire information of used hours T of the engine 2, which the PCM 4 is holding, from the PCM 4. The used hours T is the length of time during which the engine 2 subjected to the diagnosis for engine oil deterioration has been operated, that is, the used hours of the engine 2 of the vehicle.

The used hours X per predetermined period is calculated by dividing the sum of used hours T of the vehicle from the timing of vehicle production (or the timing of vehicle delivery) to the timing of determination for engine oil deterioration by the number of elapsed days D or the number of elapsed hours from the timing of vehicle production (or the timing of vehicle delivery) to the timing of determination for engine oil deterioration. For example, assuming that the sum of used hours is 10 hours from the timing of vehicle production to the timing of determination for engine oil deterioration, the sum of 10 hours is divided by 10 days which may be the number of elapsed days from the timing of vehicle production to the timing of determination for engine oil deterioration, and the used hours X per predetermined period is calculated, and in the case of the above mentioned example, the used hours X per day is calculated as one hour per day.

The annual traveling distance calculating part 16 and the used hour calculating part 18 respectively have a data reset function which may be activated at the timing of engine oil replacement. At the timing of engine oil replacement, the user, a dealer or a person concerned in the engine oil replacement or the like may actuate an engine oil replacement timing reset switch 28, provided on the instrument panel or the like, then, data relating to values for the used hours T, the number of elapsed days D, and the annual traveling distance Z after the timing of the latest engine oil replacement (or from the timing of production) held by respective ones of the annual traveling distance calculating part 16 and the used hour calculating part 18 is reset. The timing when the user or the like operated the engine oil replacement timing reset switch 28 during the engine oil replacement is sent to the PCM 4 as information relating to the timing of engine oil replacement, and measurement or calculation of the values of the used hours T, the number of elapsed days D, and the annual traveling distance Z is newly performed.

The severe condition determining part 20 functions to determine the state as severe condition when the relationship between the annual traveling distance Z and the used hours X per predetermined period meets a determining criteria of the severe condition. In such determination, the severe condition determining part 20 uses a severe condition determining map as depicted in FIG. 3.

Figure 3:
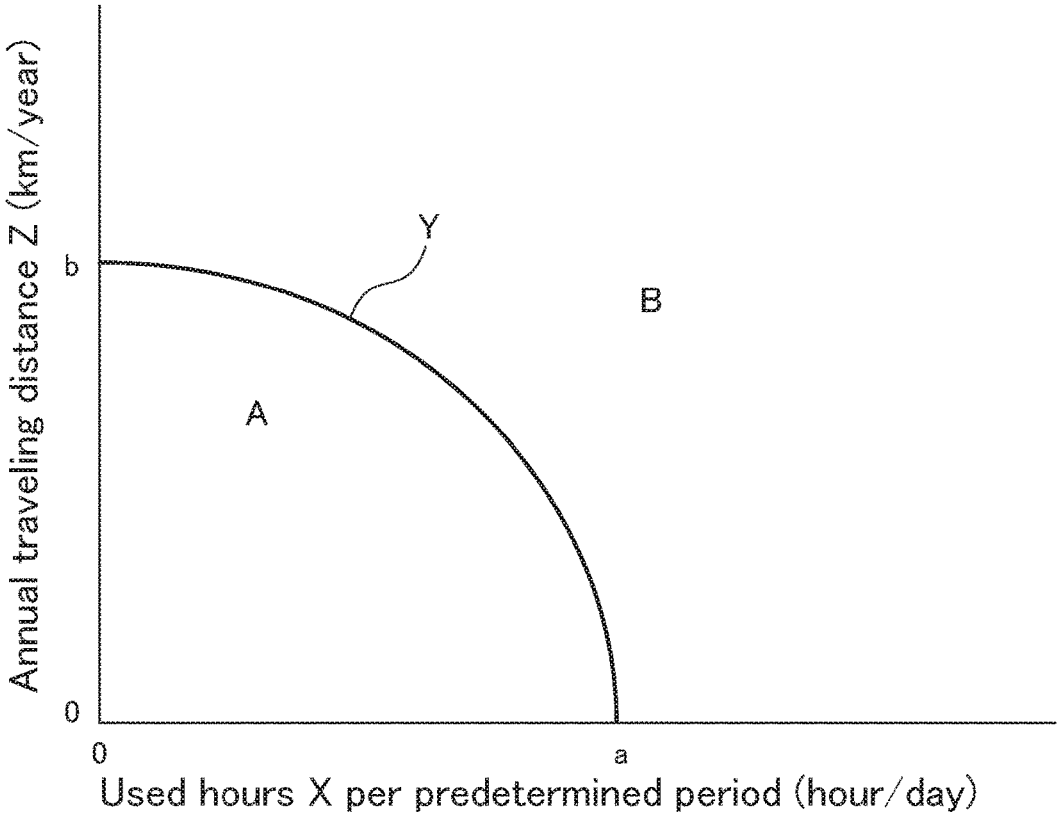
FIG. 3 is an explanatory diagram of a severe condition determining map used in a severe condition determining part of an engine oil deterioration diagnosis device according to one embodiment of the present invention.

As depicted in FIG. 3, the severe condition determining map is produced by the relationship between the annual traveling distance Z and the used hours X per predetermined period. A normal operating state region A and a severe condition region B are provided on the severe condition determining map, separated by a severe condition determining threshold value line Y. The severe condition determining part 20 functions to determine as to whether the operating state at the timing of determination of the vehicle belongs to the normal operating state region A or a severe condition region B. The operating state of the vehicle belongs to either of the normal operating state region A or the severe condition region B. When the operating state of the vehicle belongs to the severe condition region B, the severe condition determining part 20 functions to determine that the operating state of the vehicle is in the severe condition which is a situation where the operating state of the vehicle meets the determining criteria of the severe condition.

The normal operating state is a normal one where a general user, who does not use a vehicle in business, uses the vehicle in a mode conceived to be usual. The operating state in a case where the general user, who does not use the vehicle in business, uses the vehicle often belongs to the normal operating state region A. In the normal operating state, the engine oil deterioration develops with a rate which can generally be predicted. Thus, the engine oil replacement may be performed at a usual replacement timing of engine oil after the timing of the previous latest engine oil replacement. The usual replacement timing of engine oil is, for example, a timing where the traveling distance of the vehicle reaches 20000 km, assuming that traveling distance at the timing of the previous latest engine oil replacement is 0 km.

The severe condition refers that the vehicle is subjected to the severe operating condition. Taxies, delivery vehicles, official cars such as police vehicles, and buses or the like have a significantly high operating frequency, and thus, it is often the case that it is under the severe operating state where the used hours is long and/or the annual traveling distance is long. Such harsh operating state is the one belonging to the severe condition. The severe condition is also a special operating state other than the normal operating state. In the severe condition, the development of engine oil deterioration is significantly fast, and the timing that the engine oil performance deteriorates comes quickly. Thus, a necessity arises to perform the engine oil replacement at a timing earlier (shorter) than that of the usual engine oil replacement after the timing of the previous engine oil replacement. The timing of the engine oil replacement in the severe condition is a timing where the traveling distance of the vehicle reaches 10000 km, assuming that traveling distance at the timing of the previous engine oil replacement is 0 km, for example.

A severe condition determining threshold value line Y is provided by an elliptical line drawn from a threshold value "a" of the used hours X per predetermined period to a threshold value "b" of the annual traveling distance Z according to the following formula.

$$Y = \sqrt{\left(1 - \frac{x^2}{a^2}\right) \times b^2} \quad \text{Formula (1)}$$

The threshold value "a" of the used hours X per predetermined period is provided within a range where the used hours X per day is 3 hours to 6 hours, for example. The threshold value "b" of the annual traveling distance Z is provided within a range where the annual traveling distance Z is 80000 km to 120000 km, for example.

As depicted in FIG. 3, the severe condition region B is provided as a region which does not belong to the normal operating state region A on the severe condition determining map. The severe condition region B is provided in the region outside the normal operating state region A having a center on the point of used hours X per predetermined period=0.

The oil traveling distance accumulating part 24 functions to accumulate an oil traveling distance Loil calculated by the oil traveling distance calculating part 22. Specifically, the oil traveling distance calculating part 24 functions to accumulate the oil traveling distance $L_{oil}$ (hereinafter referred as Loil) calculated by any of an oil traveling distance addition correcting part 32, an oil traveling distance reduction correcting part 36, an oil traveling distance normal adding part 30 or an oil traveling distance initial correcting part 34 of the oil traveling distance calculating part 22 to calculate the accumulated oil traveling distance $L_{oilt}$ (hereinafter referred as Loilt).

The accumulated oil traveling distance Loilt represents a value obtained by accumulating the oil traveling distance Loil during the period from the timing of production or the like or the timing of the latest engine oil replacement of the vehicle to the timing of determination. The accumulated oil traveling distance Loilt is a concept different from the accumulated traveling distance Lt and/or traveling distance Lr, and it is an index parameter determined independently of the accumulated traveling distance Lt and/or the traveling distance Lr to specifically indicate a deteriorated state of engine oil by an index of the traveling distance of the oil. Such accumulated oil traveling distance Loilt also indicates a proportion up to the engine oil replacement (a proportion at which the engine oil deterioration has progressed).

The engine oil deterioration diagnosis part 26 functions to diagnose that the engine oil is in the state of deterioration when the accumulated oil traveling distance Loilt calculated by the oil traveling distance accumulating part 24 reaches a predetermined value (for example, 20000 km). The predetermined value in such case is a target value (a limit value) of the traveling distance defined in relation to the usual normal operating state, and it may be changed. According to the present embodiment, it is possible to provide the target value of the traveling distance defined in relation to the usual normal operating state as the predetermined value of the accumulated oil traveling distance Loilt without a need to determine and/or change the target value of the traveling distance, which defines the replacement timing of engine oil, in accordance with the operating state by the user. Thus, the engine oil deterioration diagnosis part 26 can function to perform determination of the engine oil replacement easily with certainty by determining as to whether the accumulated oil traveling distance Loilt has reached a single defined predetermined value.

When the result of the diagnosis by the engine oil deterioration diagnosis part 26 shows that the engine oil is in the state of deterioration, the PCM 4 functions to output a predetermined signal necessary for having the informing device 12 inform that effect to the user such as a driver or the like.

The oil traveling distance calculating part 22 functions to calculate the oil traveling distance Loil based on the traveling distance. The oil traveling distance calculating part 22 comprises the oil traveling distance normal adding part 30, the oil traveling distance addition correcting part 32, the oil traveling distance initial correcting part 34, the oil traveling distance reduction correcting part 36 and the oil traveling distance reduction limiting part 38.

The oil traveling distance normal adding part 30 functions to calculate the value of the oil traveling distance Loil by adopting the value of the traveling distance when the severe condition determining part 20 does not determine that the state is in the severe condition. Essentially, the calculation result of the oil traveling distance normal adding part 30 is adopted when the operating state of the vehicle at the timing of determination belongs to the normal operating state region A. The oil traveling distance normal adding part 30 functions to have the traveling distance actually travelled by the vehicle added to the accumulated oil traveling distance Loilt as the value of the oil traveling distance Loil. This is based on an idea that the engine oil deterioration develops with a usual speed when the vehicle is in the normal operating state.

The oil traveling distance addition correcting part 32 functions to calculate the oil traveling distance Loil by adding a predetermined value to the traveling distance when the severe condition determining part 20 determines that the state is in the severe condition. The calculation result of the oil traveling distance addition correcting part 32 is adopted when the operating state of the vehicle at the timing of determination belongs to the severe condition region B. The oil traveling distance addition correcting part 32 functions to have the oil traveling distance Loil which has been determined through an increasing correction of the traveling distance actually travelled by the vehicle, added to the accumulated oil traveling distance Loilt. With this operation, the increase in the accumulated oil traveling distance Loilt is accelerated. This is based on an idea that the engine oil deterioration develops faster than the usual speed when the operating state of the vehicle belongs to the severe condition region B.

The oil traveling distance initial correcting part 34 functions to adopt the calculation result of the oil traveling distance normal adding part 30 until the traveling distance of the vehicle reaches the predetermined traveling distance after the timing of production or the timing of engine oil replacement, and determine as to whether the calculation result of the oil traveling distance addition correcting part 32 shall be adopted for the predetermined traveling distance at the timing when the traveling distance of the vehicle reaches the predetermined traveling distance. The oil traveling distance initial correcting part 34 functions when the timing of determination belongs to an early period of determination, as seen from the production or the timing of engine oil replacement. This is based on a fact that the severe condition determination part 20 has a tendency of determining that the state is in the severe condition during the early period of determination. Thus, the oil traveling distance initial correcting part 34 can function to improve reliability of the severe condition determination by holding the result of determination by the severe condition determination part 20 until the predetermined traveling distance is reached.

The oil traveling distance reduction correcting part 36 functions to calculate the oil traveling distance Loil which is of a value reduced from the traveling distance for a period where the state not determined as the severe condition is continued, after the state is changed from the state determined as the severe condition to the state not determined as the severe condition by the severe condition determining part 20. The oil traveling distance reduction correcting part 36 is activated for a period where the state not determined as the severe condition by the severe condition determining part 20 is being continued, after the operating state of the vehicle is changed from the severe condition region B to the normal operating state region A. The oil traveling distance reduction correcting part 36 functions to calculate a value of the oil traveling distance Loil which is less than that of the usual traveling distance.

When the operating state of the vehicle moves from the severe condition region B back to the normal operating state region A, it is possible to assume that the vehicle is not used under a severe situation until the operating state is changed to the severe condition region B again. Thus, the oil traveling distance reduction correcting part 36 functions to suppress an increase in the accumulated oil traveling distance Loilt to thereby have the value of the accumulated oil traveling distance Loilt approached to the normal traveling distance Lr, by adding an oil traveling distance Loil which is of a value less than a normal traveling distance to the accumulated oil traveling distance Loilt which is of a value added with the oil traveling distance Loil to which a predetermined value has been added in the previous severe condition region B. Thus, the oil traveling distance reduction correcting part 36 functions to subtract the added part of the oil traveling distance Loil, which has previously been added because the state has been determined as the severe condition in the previous severe condition region B, to reduce or eliminate the influence so as to have the replacement timing of engine oil approached to that of the usual operating state.

The oil traveling distance reduction limiting part 38 functions to limit adoption or activation of the calculation result of the oil traveling distance reduction correcting part 36 when the accumulated oil traveling distance Loilt accumulated by the oil traveling distance accumulating part 24 becomes a value equal to the traveling distance counted from the timing of vehicle production or the timing of the engine oil replacement to the timing of determination. The oil traveling distance reduction limiting part 38 functions to limit the activation of the oil traveling distance reduction correcting part 36 when the accumulated oil traveling distance Loilt obtained by accumulating the oil traveling distance which is of a value reduced by the oil traveling distance reduction correcting part 36 becomes a value equal to the traveling distance Lr counted from the timing of vehicle production or the timing of engine oil replacement to the timing of determination, so that the adoption of the calculation result of the oil traveling distance reduction correcting part 36 is terminated to start the adoption or activation of the calculation result of the oil traveling distance normal adding part 30.

When the accumulated traveling distance Loilt is matched with the traveling distance Lr by suppressing the increase in the accumulated oil traveling distance Loilt by the oil traveling distance reduction correcting part 36 and having it approached to the usual traveling distance Lr, the oil traveling distance reduction limiting part 38 functions to determine that the vehicle operation has completely been returned to the usual operating state and functions to return or modify the determination of the state to the normal operating state.

The engine oil deterioration diagnosis device 10 according to the present embodiment may be used in combination with another engine oil deterioration determining device. For example, it may be used in combination with a device such as an engine oil deterioration determining device based on the used periods of engine oil, an engine oil deterioration determining device based on determination of an amount of soot included in the engine oil. In this case, the informing device 12 informs to the user that the replacement opportunity of engine oil has come, when either of the devices first determines that the engine oil has been deteriorated.

Next, description will be made on details of operation and process contents of the engine oil deterioration diagnosis device 10 according to the present embodiment taking reference to FIGS. 2 and 3.

Figure 2:
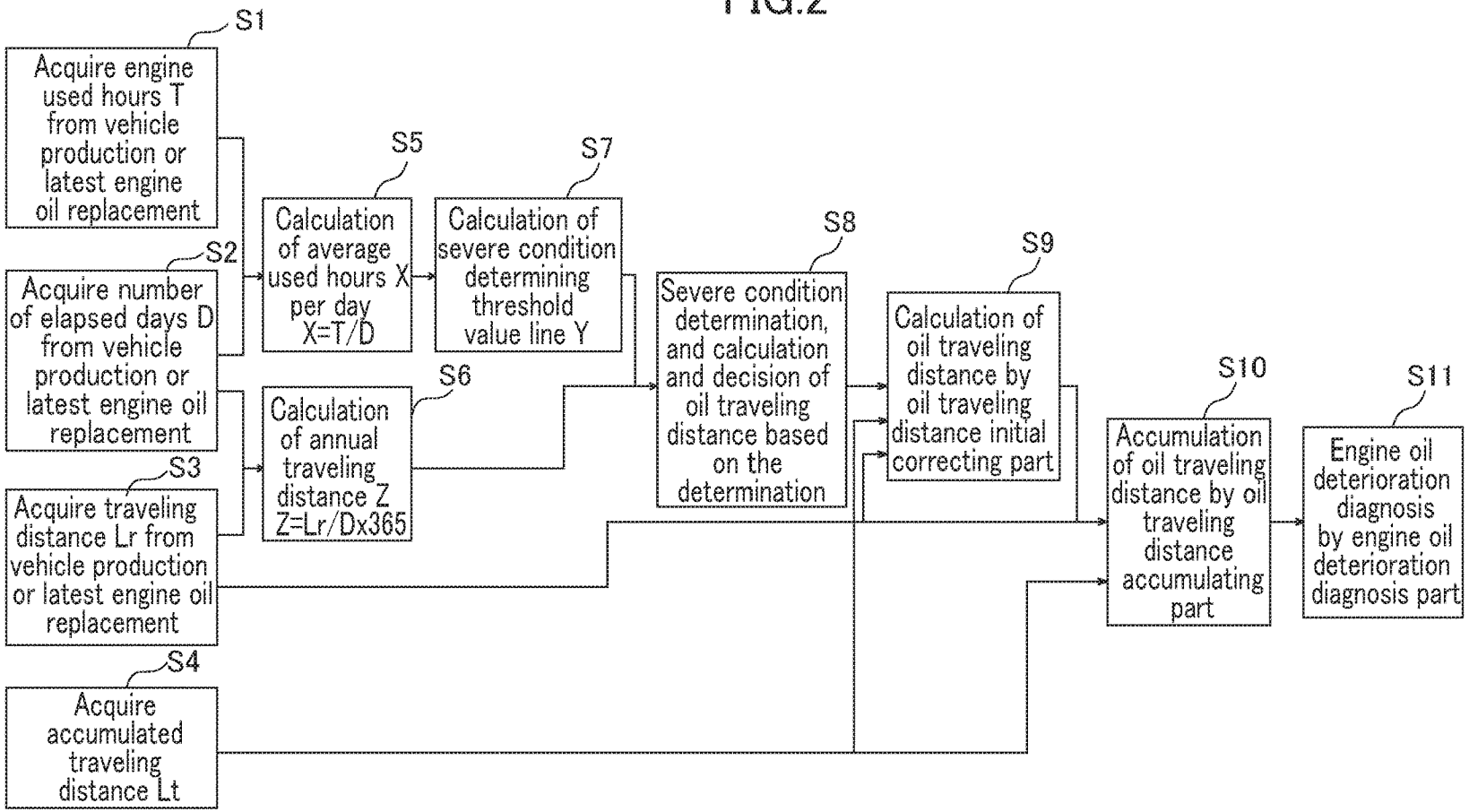
FIG. 2 is a flow chart depicting a process procedure of diagnosing engine oil deteriorated state by an engine oil deterioration diagnosis device according to one embodiment of the present invention.

FIG. 2 is a flow chart depicting the process procedure of diagnosing engine oil deteriorated state by the engine oil deterioration diagnosis device, and FIG. 3 is an explanatory diagram of the severe condition determining map used in the severe condition determining part of the engine oil deterioration diagnosis device.

Steps S1 to S3 show acquiring predetermined measurement information from the timing of vehicle production or the like or the timing of the latest engine oil replacement in the vehicle (the timing of various data reset by the engine oil replacement timing reset switch 28). Step S4 shows acquiring information of the accumulated traveling distance Lt, such as the one counted from the timing of vehicle production or the like, from which the measurement of the accumulated traveling distance Lt of the vehicle shall be started.

In the step S1, the engine oil deterioration diagnosis device 10 is activated to function for acquiring from the PCM 4 information of used hours T of the engine 2 during the period from the timing of vehicle production or the like or the timing of the latest engine oil replacement to the timing of determination.

Similarly, in the step S2, the engine oil deterioration diagnosis device 10 is activated to function for acquiring from the PCM 4 information of the number of elapsed days D and/or hours elapsed from the timing of production or the like or the timing of the latest engine oil replacement to the timing of determination.

Similarly, in the step S3, the engine oil deterioration diagnosis device 10 is activated to function for acquiring from the PCM 4 information of the traveling distance Lr counted from the timing of production or the like or the timing of the latest engine oil replacement to the timing of determination.

In addition, in step S4, the engine oil deterioration diagnosis device 10 is activated to function for acquiring from the PCM 4 information of the accumulated traveling distance Lt in the period from the timing of vehicle production or the like to the timing of determination.

In step S5, the used hour calculating part 18 functions to use the information of the used hours T acquired in the step S1 and the number of elapsed days D acquired in the step S2 to calculate the used hours Z per predetermined period of the vehicle. The used hours X per predetermined period is the average used hours per day, for example. In the step S5, the used hours X per predetermined period is calculated by dividing the used hours T of the vehicle from the timing of vehicle production or the like to the timing of determination by the number of elapsed days D from the timing of vehicle production (or the timing of vehicle delivery) to the timing of determination (X=T/D).

In step S6, the annual traveling distance calculating part 16 functions to use the information of the number of elapsed days D acquired in the step S2 and the traveling distance Lr acquired in the step S3 to calculate the annual traveling distance Z (corresponding value of the traveling distance per year). In the step S6, the annual traveling distance Z is calculated by multiplying 365 (days) to a value obtained by dividing the traveling distance Lr of the vehicle from the timing of engine oil replacement or the like in the vehicle to the timing of determination by the number of elapsed days D from the timing of engine oil replacement or the like in the vehicle to the timing of determination (Z=Lr/D×365).

In step S7, the severe condition determining part 20 functions to determine the severe condition determining threshold value line Y on the severe condition determining map produced by the relationship between the annual traveling distance Z and the used hours X per predetermined period.

In step S8, the severe condition determining part 20 functions to determine as to whether the operating state of the vehicle at the timing of determination corresponding to the determined respective positions of Z and X belongs to the normal operating state region A which is the region on and inside the severe condition determining threshold value line Y, or belongs to the severe condition region B outside the line Y on the severe condition determining map.

The severe condition determining part 20 functions to determine that the operating state of the vehicle at the timing of determination belongs to the severe condition region B when a condition of Z>T is met, specifically, Z (the point corresponding to the respective values Z and X on the severe condition determination map) falls in the region outside the line Y. When the severe condition determining part 20 determines that the operating state of the vehicle at the timing of determination belongs to the severe condition region B, the oil traveling distance addition correcting part 32 of the oil traveling distance calculating part 22 is activated to function for performing a calculation to correct the oil traveling distance Loil.

The oil traveling distance addition correcting part 32 functions to calculate the oil traveling distance Loil by adding a predetermined value (a penalty traveling distance P) to the traveling distance Lb while the vehicle belongs to the severe condition region B. The oil traveling distance Loil is represented by the following formula.

$$Loil=Lb+P \qquad \text{Formula (2)}$$

Further, when the operating state of the vehicle continuously belongs to the severe condition region B from the timing of the latest engine oil replacement of the vehicle to the timing of determination, the traveling distance Lb is represented as Lb=Lr.

The penalty traveling distance P is determined as a predetermined value of the traveling distance Lb×addition correcting coefficient ("1.0"), for example. Specifically, in a case where the operating state of the vehicle at the timing of determination belongs to the severe condition region B, and when the vehicle has travelled for a distance corresponding to the traveling distance Lb, the penalty traveling distance P is calculated as P=Lb×1.0=Lb. Further, for the addition correcting coefficient to be multiplied to the traveling distance Lb (1.0, in the present embodiment), other values such as 0.8 or 1.2 or the like may be used. When the addition correcting coefficient of the present embodiment is 1.0, Loil becomes twice the traveling distance Lb.

Thus, by performing the correction through an addition of the penalty traveling distance P to the actual traveling distance Lb in the severe condition region B where it is conceived that the engine oil deterioration (engine oil damage) is more intense than usual, it is regarded that the engine oil has been used for a distance wherein the penalty traveling distance P is added to the actual traveling distance Lb. Thus, it is possible to reflect the state where the engine oil deterioration is more intense than usual to the replacement timing of engine oil.

The severe condition determining part 20 functions to determine that the operating state of the vehicle at the timing of determination belongs to the normal operating state region A when a condition Z≤Y is met, specifically, Z (the point corresponding to the respective values Z and X on the severe condition determination map) falls on or inside the line of Y. In this case, the oil traveling distance normal adding part 30 or the oil traveling distance reduction correcting part 36 of the oil traveling distance calculating part 22 functions to calculate the oil traveling distance Loil.

Essentially, when the operating state of the vehicle at the time of determination belongs to the normal operating state region A, the calculation result of the oil traveling distance normal adding part 30 of the oil traveling distance calculating part 22 is adopted. The oil traveling distance normal adding part 30 functions to adopt the traveling distance La during the period wherein the vehicle belongs to the normal operating state region A for the value of the oil traveling distance Loil. Specifically, the oil traveling distance normal adding part 30 functions to determine (or calculate) Loil=La×1.0, omitting correction processing such as addition of the penalty traveling distance P or the like. Further, it is to be noted that Lr=La+Lb.

If the operating state of the vehicle continuously belongs to the normal operating state region A at the timing of determination after the change of the operating state of the vehicle from the severe condition region B to the normal operating state region A, the calculation result of the oil traveling distance reduction correcting part 36 of the oil traveling distance calculating part 22 is adopted. The oil traveling distance reduction correcting part 36 functions to calculate the oil traveling distance Loil determined through a reducing correction of the traveling distance La during the period wherein the operating state of the vehicle belongs to the normal operating state region A after the operating state of the vehicle has changed from the severe condition region B to the normal operating state region A. Here, the oil traveling distance Loil is represented by the following formula.

$$Loil=La\times 0.5 \qquad \text{Formula (3)}$$

Thus, by calculating the oil traveling distance Loil determined through the reducing correction based on the traveling distance La, the increase in the accumulated oil traveling distance Loilt is suppressed than the increase in the actual traveling distance. Further, other values may be used for a reduction correcting coefficient (0.5, in the present embodiment) to be multiplied to the traveling distance La.

Further, the oil traveling distance Loil having a reduced value calculated by the oil traveling distance reduction correcting part 36 is continuously accumulated to produce the accumulated oil traveling distance Loilt, so that there may be a case where the value of the accumulated oil traveling distance Loilt becomes equal to the traveling distance Lr. In such case, in order to limit the adoption of the calculation result of the oil traveling distance reduction correcting part 36 which functions to calculate the oil traveling distance Loil lower than the traveling distance, the adoption of the calculation result of the oil traveling distance reduction correcting part 36 is terminated. Then, further, the adoption of the calculation result of the oil traveling distance normal adding part 30, which functions to adopt the value of the traveling distance as that of the oil traveling distance Loil, is started.

In step S9, the oil traveling distance initial correcting part 34 functions to determine as to whether the traveling distance Lr (or the accumulated traveling distance Lt) of the vehicle at the timing of determination has reached a predetermined initial traveling distance (for example, 2000 km) from the timing of production or the timing of engine oil replacement. The oil traveling distance initial correcting part 34 functions to adopt or activate the calculation result of the oil traveling distance normal adding part 30 until the traveling distance Lr (or the accumulated traveling distance Lt) of the vehicle at the timing of determination reaches the predetermined initial traveling distance counted from the timing of vehicle production or the engine oil replacement. In addition, the oil traveling distance initial correcting part 34 functions to determine as to whether the calculation result of the oil traveling distance addition correcting part 32 shall be adopted for the predetermined initial traveling distance at and after the timing when the traveling distance Lr (or the accumulated traveling distance Lt) has reached the predetermined initial traveling distance.

Description will more specifically be made on the above process where the oil traveling distance initial correcting part 34 functions to adopt or activate the calculation result of the oil traveling distance normal adding part 30.

The severe condition determining part 20 functions to determine as to whether the operating state of the vehicle at the timing of determination belongs to the normal operating state region A or the severe condition region B on the severe condition determining map even during the period before the traveling distance of the vehicle reaches the predetermined initial traveling distance.

Here, the oil traveling distance initial correcting part 34 functions to hold the result of determination by the severe condition determination part 20 during the period before the traveling distance of the vehicle reaches the predetermined initial traveling distance. Specifically, the oil traveling distance initial correcting part 34 functions to use the oil traveling distance normal adding part 30, assuming that the operating state of the vehicle at the timing of determination is in the state belonging to the normal operating state region A, irrespective of the determination result, and apply the traveling distance La as the value of the oil traveling distance Loil.

Therefore, during the period before the traveling distance of the vehicle reaches the predetermined initial traveling distance, the oil traveling distance initial correcting part 34 functions to use the oil traveling distance normal adding part 30, and adopt the oil traveling distance Loil, even if the annual traveling distance Z and the used hours X per predetermined period respectively become relatively high values by a temporal long traveling distance or the like which may lead to a determination of the severe condition.

Next, description will more specifically be made on a process of the oil traveling distance initial correcting part 34 for determining as to whether the calculation result of the oil traveling distance addition correcting part 32 should be adopted for the predetermined initial traveling distance at the point when the traveling distance Lr (or the accumulated traveling distance Lt) has reached the predetermined initial traveling distance.

If the operating state of the vehicle at the timing when the traveling distance of the vehicle has reached the predetermined initial traveling distance (specifically, the timing where a certain period of time has elapsed so that the determination of the severe condition may be stably performed) belongs to the severe condition region B, it is conceived that the vehicle has travelled the predetermined initial traveling distance under the sever condition on average. Thus, the oil traveling distance initial correcting part 34 functions to reflect an evaluation based on this conception to the oil traveling distance Loil. It is thereby possible to accurately understand the state of engine oil deterioration to appropriately determine the replacement timing of engine oil.

Specifically, the oil traveling distance initial correcting part 34 functions to have the oil traveling distance addition correcting part 32 calculate the oil traveling distance Loil (=Lr+P) with respect to the predetermined initial traveling distance Lr (for example, 2000 km) at the timing when the traveling distance Lr (or the accumulated traveling distance Lt) has reached the predetermined traveling distance. The above formula is determined by Lb=Lr in the formula (2). In this case, Lr is the predetermined initial traveling distance 2000 km, and the penalty traveling distance P=Lr×1.0=2000 km. Thus, it is possible to obtain a result of calculation indicating that the oil traveling distance Loil is 4000 km.

On the other hand, if the operating state of the vehicle at the timing when the traveling distance of the vehicle has reached the predetermined initial traveling distance is determined as belonging to the normal operating state region A, it is conceived that the vehicle has travelled the predetermined initial traveling distance under the normal operating state region A on average. Thus, the oil traveling distance initial correcting part 34 functions to reflect the evaluation based on this conception to the oil traveling distance Loil. It is thereby possible to accurately understand the state of engine oil deterioration to appropriately determine the replacement timing of engine oil.

During the period from the timing of production of the vehicle or the timing of engine oil replacement to the timing when the predetermined initial traveling distance is reached, the values of the number of elapsed days D and/or the hours elapsed from the timing of vehicle production (or the timing of vehicle delivery) to the timing of determination which is to be used as the base of the calculation of the annual traveling distance Z and the used hours X per predetermined period will become small. Therefore, in a case where the vehicle temporarily travels a relatively long distance (for example, the case where the vehicle temporarily travels a relatively long distance such as a use on vacation), the values of respective ones of the annual traveling distance Z and the used hours X per predetermined period tend to become relatively high, and thus, there is a possibility that the state is determined as the severe condition. Thus, the oil traveling distance initial correcting part 34 is configured to determine as to whether the calculation result of the oil traveling distance addition correcting part 32 is adopted (or activated) or not by the aforementioned process. It is thereby possible to further improve accuracy of the determination of the severe condition, improve accuracy of the oil traveling distance Loil and to appropriately determine the replacement timing of engine oil.

In step S10, the oil traveling distance accumulating part 24 functions to accumulate each of the oil traveling distance Loil calculated by respective ones of the oil traveling distance addition correcting part 32, the oil traveling distance reduction correcting part 36, the oil traveling distance normal adding part 30 and the oil traveling distance initial correcting part 34 of the oil traveling distance calculating part 22. The oil traveling distance accumulating part 24 is always in a state of accumulating the oil traveling distance Loil, and functions to add the oil traveling distance Loil calculated or decided by either one of the oil traveling distance addition correcting part 32, the oil traveling distance reduction correcting part 36, the oil traveling distance normal adding part 30 and the oil traveling distance initial correcting part 34, depending on the operating state at the timing of determination of the vehicle, to the accumulated oil traveling distance Loilt accumulated up to this timing.

The oil traveling distance accumulating part 24 functions to calculate the accumulated oil traveling distance Loilt independent of the accumulated traveling distance Lt by performing a process for accumulating the oil traveling distance Loil independent of the accumulation of the actual traveling distance and in parallel. Therefore, in the present embodiment, it is possible to determine the replacement timing of engine oil appropriately and accurately by a unique index, that is, the oil traveling distance Loil independent of the traveling distance.

In step S11, the engine oil deterioration diagnosis part 26 functions to diagnose that the engine oil is in the state of deterioration when the accumulated oil traveling distance Loilt accumulated by the oil traveling distance accumulating part 24 reaches the predetermined value (20000 km). In addition, in this case, the informing device 12 informs the user that the replacement opportunity of engine oil is has come.

In the engine oil deterioration diagnosis device 10 according to the present embodiment described above, when the severe condition determining part 20 determines that the state is in the severe condition based on the relationship between the annual traveling distance Z and the used hours per predetermined period X, the oil traveling distance addition correcting part 32 can function to calculate the oil traveling distance Loil by adding a predetermined value to the traveling distance, and when the accumulated oil traveling distance Loilt reaches the predetermined value, the engine oil deterioration diagnosis part 26 can function to diagnose that the engine oil is in the state of deterioration. With this operation, in the present embodiment, it is possible to appropriately diagnose engine oil deterioration from two aspects, namely, the traveling distance and the operating frequency represented by used hours X per predetermined period.

In addition, in the engine oil deterioration diagnosis device 10 according to the present embodiment, the oil traveling distance initial correcting part 34 functions to adopt or activate the calculation result of the oil traveling distance normal adding part 30 by holding the result of determination by the severe condition determination part 20 during the period from the timing of production or the timing of engine oil replacement to the timing when the traveling distance of the vehicle reaches the predetermined traveling distance, and determine as to whether the calculation result of the oil traveling distance addition correcting part shall be adopted or activated for the predetermined traveling distance after the traveling distance reached the predetermined traveling distance. Thus, it is possible to prevent the state to be determined as the sever condition even when a relatively long distance is temporarily travelled during the period before the traveling distance of the vehicle reaches the predetermined traveling distance counted from the vehicle production or the timing of engine oil replacement. With this operation, in accordance with the present embodiment, it is possible to further improve accuracy of the determination of the severe condition, and accurately diagnose engine oil deterioration from two aspects, namely, the traveling distance and the operating frequency represented by used hours X per predetermined period, to thereby appropriately determine the timing of engine oil replacement.

In addition, in the engine oil deterioration diagnosis device 10 according to the present embodiment, after the determination of the operating state by the severe condition determination part 20 is changed from the state determined as the severe condition to the state not determined as the severe condition, during the period where the state not determined as the severe condition is being continued, the oil traveling distance reduction limiting part 36 functions to calculate the oil traveling distance Loil having a value reduced from the traveling distance. This operation is done considering that under a situation wherein the traveling distance became temporarily long for a limited period, but after that, there may be a possibility that the operating state may have returned to the usual mode. Thus, under a situation where the state is determined as the severe condition, the oil traveling distance addition correcting part 32 calculates the oil traveling distance including a predetermined value added, but after the change of the determination of the state, the reduced oil traveling distance Loil is used, so that it is possible to reduce the increase in the accumulated oil traveling distance Loilt, to thereby effect correction to have the value of the accumulated oil traveling distance Loilt approached to the actual traveling distance.

Thus, even if there occurs temporarily a state determined as the operating state of the severe condition, after the operating state is returned to the usual mode, it is possible to correct the accumulated oil traveling distance Loilt to thereby have it approached to the accumulated value of the actual traveling distance. It is thereby possible in the present embodiment to more accurately diagnose engine oil deterioration in terms of two aspects, namely the traveling distance and the operating frequency represented by used hours X per predetermined period to thereby appropriately determine the timing of engine oil replacement.

In addition, in the engine oil deterioration diagnosis device 10 according to the present embodiment, in a case where the correction for having the accumulated oil traveling distance Loilt approached to the actual traveling distance is performed using the reduced oil traveling distance Loil calculated by the oil traveling distance reduction correcting part 36, when the accumulated oil traveling distance Loilt calculated by the oil traveling distance accumulating part 24 for the period from the timing of vehicle production or the timing of engine oil replacement to the timing of determination became a value equal to the traveling distance from the timing of vehicle production or the timing of engine oil replacement to the timing of determination, the oil traveling distance reduction limiting part 38 functions to limit the adoption or activation of the calculation result of the oil traveling distance reduction correcting part 36 so that the accumulated oil traveling distance Loilt may not become smaller than the actual traveling distance from the timing of vehicle production or the timing of engine oil replacement to the timing of determination.

Thus, in accordance with the present embodiment, under a situation where the state has been determined temporarily as the operating state of the severe condition but has been returned to the operating state of the usual mode, it is possible to limit the adoption or activation so that the accumulated oil traveling distance Loilt may not become equal to or less than the actual traveling distance, to thereby return to the calculation of the oil traveling distance Loil under the operating state of the usual mode. Therefore, in the present embodiment, it is possible to more accurately diagnose engine oil deterioration in terms of two aspects, namely, the traveling distance and the operating frequency represented by used hours X per predetermined period to thereby make it possible to appropriately determine the timing of engine oil replacement.

LIST OF REFERENCE NUMERALS

1: engine system
2: engine
4: power train control module
8: traveling distance detecting device
10: engine oil deterioration diagnosis device
12: informing device
16: annual traveling distance calculating part
18: used hour calculating part
20: severe condition determining part
22: oil traveling distance calculating part
24: oil traveling distance accumulating part
26: engine oil deterioration diagnosis part
30: oil traveling distance normal adding part
32: oil traveling distance addition correcting part
34: oil traveling distance initial correcting part
36: oil traveling distance reduction correcting part
38: oil traveling distance reduction limiting part
A: normal operating state region
B: severe condition region
D: number of elapsed days
Loil: oil traveling distance
Loilt: accumulated oil traveling distance
P: penalty traveling distance
T: used hours
X: used hours per predetermined period
Y: determining threshold value line
Z: annual traveling distance

What is claimed is:

1. An engine oil deterioration diagnosis device for diagnosing engine oil deterioration in an engine of a vehicle, comprising:

an annual traveling distance calculating part for calculating an annual traveling distance based on a traveling distance detected by a traveling distance detecting device;

a used hour calculating part for calculating used hours per predetermined period of the vehicle based on used hours of the vehicle;

a severe condition determining part for determining a severe condition when a relationship between the annual traveling distance and the used hours per predetermined period meets a determining criteria of the severe condition;

an oil traveling distance calculating part for calculating an oil traveling distance based on the traveling distance;

an oil traveling distance accumulating part for accumulating the oil traveling distance calculated by the oil traveling distance calculating part to calculate an accumulated oil traveling distance; and an engine oil deterioration diagnosis part for diagnosing that the engine oil is in a state of deterioration when the accumulated oil traveling distance calculated by the oil traveling distance accumulating part reached a predetermined value;

wherein the oil traveling distance calculating part comprises:

an oil traveling distance normal adding part for calculating the oil traveling distance by adopting the traveling distance, when the severe condition determining part does not determine the state as being in the severe condition; and an oil traveling distance addition correcting part for calculating the oil traveling distance by adding a predetermined value to the traveling distance, when the severe condition determining part determines the state as being in the severe condition.

2. The engine oil deterioration diagnosis device as recited in claim 1, wherein the oil traveling distance calculating part further comprises an oil traveling distance initial correcting part, wherein the oil traveling distance initial correcting part is configured to adopt the oil traveling distance calculated by the oil traveling distance normal adding part until the traveling distance of the vehicle reaches a predetermined value counted from the timing of vehicle production or the timing of engine oil replacement, and to determine as to whether the oil traveling distance calculated by the oil traveling distance addition correcting part shall be adopted for the predetermined traveling distance after the traveling distance of the vehicle has reached the predetermined traveling distance.

3. The engine oil deterioration diagnosis device as recited in claim 1, wherein the oil traveling distance calculating part further comprises an oil traveling distance reduction correcting part, wherein the oil traveling distance reduction correcting part is configured to calculate a reduced oil traveling distance having a value reduced from the traveling distance during a period when, after determination of a state by the severe condition determining part has changed from the severe condition to a non-severe condition, the state determined as the non-severe condition continues.

4. The engine oil deterioration diagnosis device as recited in claim 3, wherein the oil traveling distance calculating part further comprises an oil traveling distance reduction limiting part, wherein the oil traveling distance reduction limiting part is configured to limit the adoption of the oil traveling distance calculated by the oil traveling distance reduction correcting part if the accumulated oil traveling distance obtained by accumulating the reduced oil traveling distance calculated by the oil traveling distance reduction correcting part becomes equal to a value of the traveling distance in the period from the timing of vehicle production or the timing of engine oil replacement to the timing of determination.

* * * * *